US006390078B1

(12) United States Patent
Gee et al.

(10) Patent No.: US 6,390,078 B1
(45) Date of Patent: May 21, 2002

(54) TWO STAGE CONCENTRIC EGR VALVES

(75) Inventors: Paul Timothy Gee, Mendon; James M. Keogan, Webster; Richard Francis Nashburn, Honeoye Falls, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/551,699

(22) Filed: Apr. 18, 2000

(51) Int. Cl.[7] ..... F02B 47/08

(52) U.S. Cl. ..... 123/568.2; 123/568.21; 123/79 C

(58) Field of Search ..... 123/568.2, 568.21, 123/568.11, 568.26, 79 C; 251/129.01, 129.15

(56) References Cited

U.S. PATENT DOCUMENTS

| | | | | |
|---|---|---|---|---|
| 5,357,914 A | * | 10/1994 | Huff | 123/79 C |
| 5,460,146 A | * | 10/1995 | Frankenberg | 123/571 |
| 5,626,327 A | * | 5/1997 | Clark | 251/129.15 |
| 5,782,215 A | * | 7/1998 | Engelmann | 123/79 C |
| 5,911,401 A | * | 6/1999 | Hrytzak et al. | 251/129.15 |
| 6,189,519 B1 | * | 2/2001 | Press et al. | 123/568.26 |

* cited by examiner

*Primary Examiner*—Willis R. Wolfe
*Assistant Examiner*—Mahmoud Gimie
(74) *Attorney, Agent, or Firm*—John VanOphem

(57) ABSTRACT

A two stage exhaust gas recirculation (EGR) valve delivers a wide range of EGR flow while operating with reduced valve actuating forces allowing use of a reduced cost actuator such as a solenoid with smaller sized coil and armature. An attached valve body mounts concentric dual pintle valves including a larger first valve, which engages a valve seat in the valve body to control exhaust gas flow between inlet and outlet openings and a smaller second valve positioned inside the first valve and engaging a second valve seat in the head of the first valve. The second valve controls a low flow passage inside the first valve. The solenoid armature engages only the smaller second valve during a first stage of its stroke so that the smaller valve is opened first and flow control is maintained in a low flow range. Exhaust and intake differential pressures acting on the second valve are overcome by a smaller armature force because of the smaller area of the second valve. In a second stage of its stroke, the armature also engages the first valve, forcing it off its seat and providing a greater amount of exhaust flow. Opening of the larger first valve requires less force than a single pintle valve because the flow from the open smaller valve reduces the pressure differential in the valve body and thus reduces the force opposing opening of the larger valve.

10 Claims, 3 Drawing Sheets

TWO STAGE CONCENTRIC EGR VALVES

TECHNICAL FIELD

This invention relates to exhaust gas recirculation valves for internal combustion engines and more particularly to solenoid actuated pintle type valves having sequential dual flow stages.

BACKGROUND OF THE INVENTION

It is known in the art to provide an automotive internal combustion engine with an exhaust gas recirculation (EGR) valve to control a flow of exhaust gases into the engine induction system and limit the formation of nitrogen oxides (NOx) in the engine. Known valve constructions include pintle type valves which have an axially movable valve with a shaped mushroom-like head connected with an axial pintle shaft. The head is seatable upon a valve seat within a valve body and controls flow between inlet and outlet openings on opposite sides of the valve seat. An actuator such as a solenoid actuated armature is provided to controllably drive the valve axially and open the valve in a controlled manner to obtain the amount of EGR required under various engine operating conditions. A valve spring biases the valve in a closing direction to close the valve when the armature is returned to the initial valve closed position.

Where a large variation in EGR flow is required, the pintle head and orifice are shaped to provide the required variation in flow. However, a relatively long travel of the armature may be required in such valves. In addition, the solenoid force required to open the valve from the closed position must be large enough to overcome unbalanced pressures in the valve body or seat tube so that a relatively large solenoid coil and armature maybe needed. It is accordingly desired to provide a solenoid or otherwise actuated EGR valve that operates with a lower actuating force while providing a full range of controlled exhaust gas recirculation flow.

SUMMARY OF THE INVENTION

The presentation invention provides two stage exhaust gas recirculation (EGR) valves that can deliver a wide range of EGR flow while operating with reduced valve actuating forces. A reduced cost actuator, such as a solenoid actuator with smaller sized coil and armature, may thus be used for actuating the valves. An attached valve body mounts dual pintle valves including a larger first valve which engages a valve seat in the valve body to control exhaust gas flow between inlet and outlet openings on axially opposite sides of the valve seat. A smaller second valve is positioned inside the first valve and engages a second valve seat in the head of the first valve. The second valve controls a low flow passage inside the first valve to also control a lower volume of exhaust gas flow between the inlet and outlet openings.

The solenoid armature engages only the smaller second valve during a first stage of its stroke so that the smaller valve is opened first and flow control is maintained in a low flow range. Exhaust and intake pressures acting on the second valve require low force to overcome because of the smaller area of the second valve. In a second stage of its stroke, the armature also engages the first valve, forcing it off its seat and providing a greater amount of exhaust flow. Opening of the larger first valve requires less force than single pintle valves because the flow from the open smaller valve reduces the opposing opening of the larger valve.

The dual concentric pintle valve design may also be applied to partially or fully balanced valves to provide better control of EGR flow over the full control range of the valve. Additional effective travel of the valve armature may be obtained by underlap of the armature and its magnetic pole so that the smaller valve is opened as the armature force increases to a maximum, leaving the maximum armature force for opening of the larger valve.

These and other features and advantages of the invention will be more fully understood from the following description of certain specific embodiments of the invention taken together with the accompanying drawings.

DESCRIPTION OF THE PREFERRED EMBODIMENT

Figure 1:
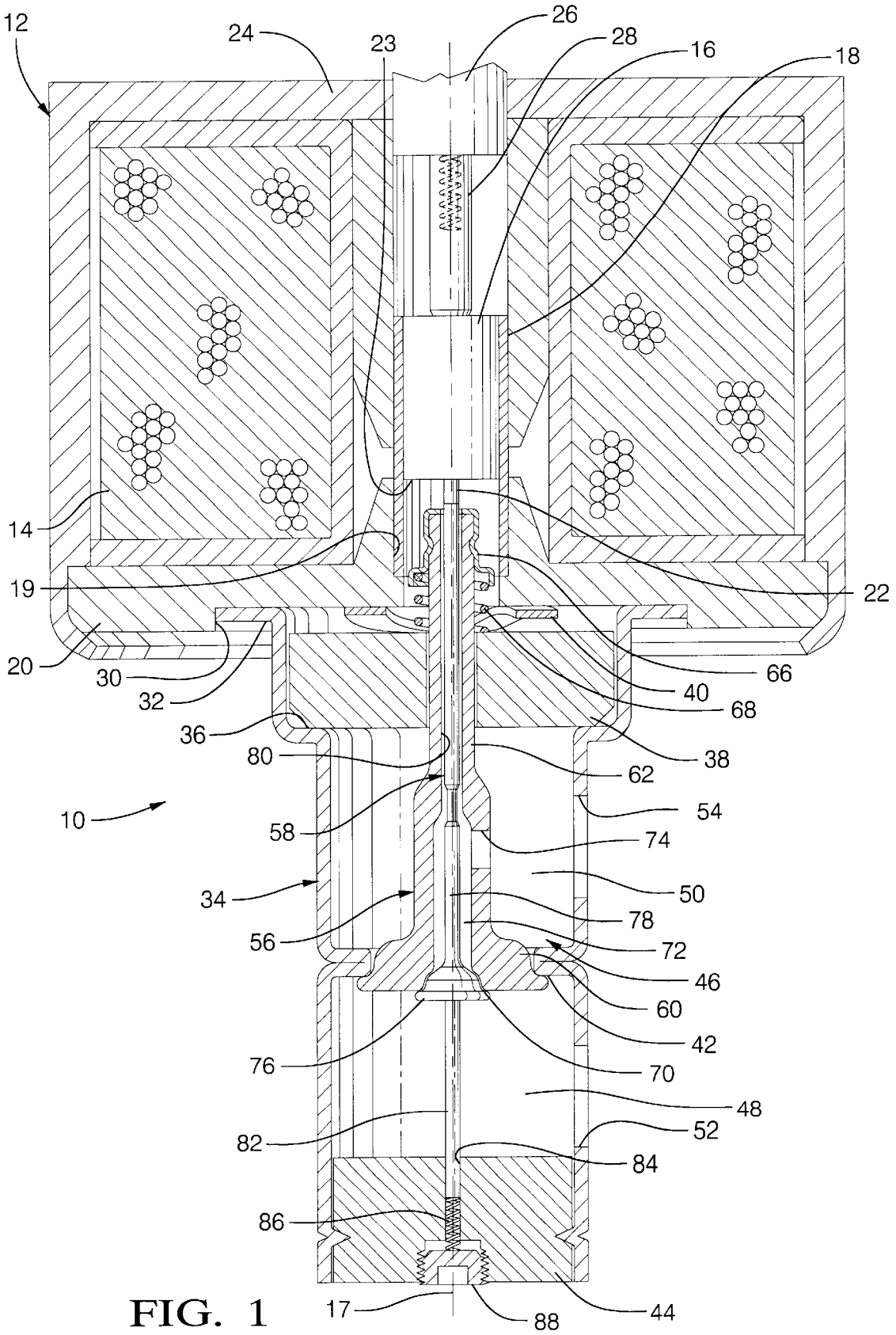
FIG. 1 is a cross-sectional view through a solenoid actuated two-stage concentric pintle EGR valve in accordance with the invention.

Referring first to FIG. 1 of the drawings in detail, numeral 10 generally indicates a two-stage exhaust gas recirculation (EGR) valve in accordance with the invention. Valve 10 includes an upper housing 12 enclosing a magnetic coil 14 surrounding an armature 16 reciprocable on an axis 17 within a non-magnetic sleeve 18. The sleeve 18 extends into a recess 19 in a primary pole piece 20 extending outwardly under the coil 14 and forming a lower wall of the housing 12. While the armature 16 may be of any suitable shape, it is preferably cylindrical and, in the present instance, includes a small protrusion 22 on its primary lower surface 23 extending axially downward for a purpose to be subsequently described. The housing also includes a secondary pole piece 24 extending across upper portions of the coil 14. A position sensor 26 may be mounted on the top of the housing having a spring-loaded drive arm 28 engaging the top of the armature to sense its position for control purposes.

Centrally positioned on the lower side of the primary pole piece 20 is a circular recess 30 in which is received a flanged upper portion 32 of a thin wall drawn metallic seat tube or valve body generally indicated by numeral 34. The valve body 34 is generally cylindrical although the upper portion 32 is enlarged and includes a stepped portion defining an annular abutment 36. A floating bushing 38 is received in the upper portion 32 and seats against the abutment 36. A wave spring 40 between the pole piece 20 and the bushing 38 holds the floating bushing downward against the abutment 36. Below the abutment 36, the valve body 34 is generally cylindrical, having an inwardly extending valve seat 42 intermediate its ends and an end cap and bushing 44 crimped into its open lower end.

The lower portion of the valve body 34 defines internally a valve chamber 46 divided by the valve seat into a lower inlet portion 48 and an upper outlet portion 50. An inlet opening 52 communicates with the inlet portion to receive exhaust gas from the exhaust system, not shown, of an associated engine. An outlet opening 54 communicates with the outlet portion to deliver recirculated exhaust gas to the intake system, not shown, of the associated engine.

Within the valve chamber 46, first and second pintle valves 56, 58, respectively, are mounted for reciprocation on the axis 17. The first valve 56 includes a head 60 adapted to seat against the valve seat 42. The head connects with a hollow pintle shaft 62 that extends up through a close clearance opening in the floating bushing 38 into a lower portion of the sleeve 18 within the primary pole piece recess 19. An upper end of the shaft 62 is spaced a predetermined distance below the axially adjacent primary lower surface 23 of the armature 16 for a purpose to be subsequently described. A retainer cap 66 is crimped onto the upper end of the valve shaft 62 and retains a biasing spring 68 extending between the cap 66 and the floating bushing 38 for biasing the first pintle valve in a closing direction toward the valve seat 42.

The second pintle valve 58 is concentrically mounted within the first pintle valve 56 which internally defines a second valve seat 70 at the lower end of the valve head 60. The valve seat 70 communicates with an axially extending low flow passage 72 that extends upward within the valve shaft 62 to an outlet opening 74.

The second pintle valve 58 includes a relatively smaller valve head 76 that is seatable against the second valve seat 70 in the first pintle valve 56. Valve 58 further includes a pintle shaft 78 that extends axially up through low flow passage 72 in the first valve and upward into close supporting clearance with a reduced diameter portion 80 of the hollow interior of the first pintle shaft 62. Shaft 78 extends upward into contact with the downward protrusion 22 of the armature.

Below the second valve head 76, a lower pintle shaft 82 extends downward into a guide opening 84 in the bushing and end cap 44. Shaft 84 engages a second biasing spring 86 which is adjustable by a set screw 88 located at the bottom end of the end cap 44 and closing the lower end of the guide opening 84.

In assembly with an engine, housing 12 is mounted upon an outer surface of an engine component, such as a cylinder head or manifold, and the seat tube or valve body 34 extends downward into an opening within the engine component, not shown. The lower inlet portion 48 of the valve chamber communicates through opening 52 with a passage, not shown, in the exhaust system of the engine and the upper outlet portion 50 of the valve chamber communicates through an outlet opening 54 with a passage not shown in the induction system of the engine.

In operation, when only a small amount of exhaust gas recirculation is required, the coil 14 is energized at a low level, causing the armature 16 to move downward a small amount. The downward motion forces protrusion 22 of the armature against the shaft 62 of the second pintle valve 58, forcing it downward against biasing spring 86. This opens the low flow passage 78 to flow from the inlet portion 48 of the valve chamber, past the second valve head 76 and through the low flow passage 72 to outlet opening 74. There, the exhaust gas passes out into the outlet portion 50 of the valve chamber and out through outlet opening 54 into the engine induction system, not shown.

This initial downward movement of armature 16 requires a relatively low force to open the second pintle valve 58 because the small size of the valve head 76 limits the force of differential exhaust and inlet pressures acting on the head 76. If the need for EGR flow remains low, the energy of the magnetic coil 14 is controlled at a low level to obtain the desired amount of exhaust gas flow by movement only of the second pintle valve 58 toward and away from its seat 70 located in the head of the first pintle valve.

When a greater flow of recirculated exhaust gas is required, the magnetic energy of the coil is increased, causing the armature 16 to move further downward until its primary lower surface 23 engages the retainer cap 66 at the upper end of the first pintle valve shaft 62. Further downward motion of the armature forces the first pintle valve 56 downward, moving the head 60 off its seat and opening the first valve to greater flow past the valve seat 42 from the lower portion 48 to the upper portion 52 of the valve chamber.

Because opening of the smaller second pintle valve precedes opening of the larger first pintle valve in every case, a flow of exhaust gases through the low flow passage 72 reduces the pressure differential between the inlet and outlet portions of the valve chamber 46 prior to opening of the first pintle valve 56. The reduced pressure differential results in a reduced requirement for magnetic energy to open the first pintle valve and thus the size of the magnetic coil 14 and armature 16 required for actuating the concentric dual pintle valves of the invention is reduced as compared to a single pintle valve which must be opened against a larger pressure differential between inlet and outlet portions of a valve chamber. The design accordingly allows reduction of the size of the solenoid members of the EGR valve 10, resulting in a more compact construction and a reduction in cost. At the same time, better control is provided of EGR flow through the valve by the dual stage operation of the second and first pintle valves.

Figure 2:
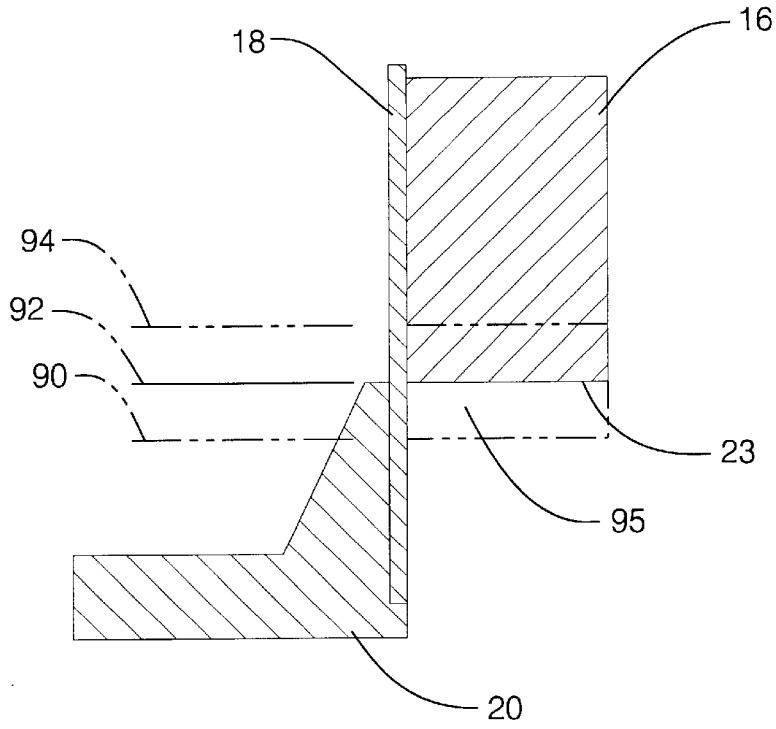
FIG. 2 is a schematic view illustrating various initial positions of the valve armature relative to an associated magnetic pole.
Figure 3:
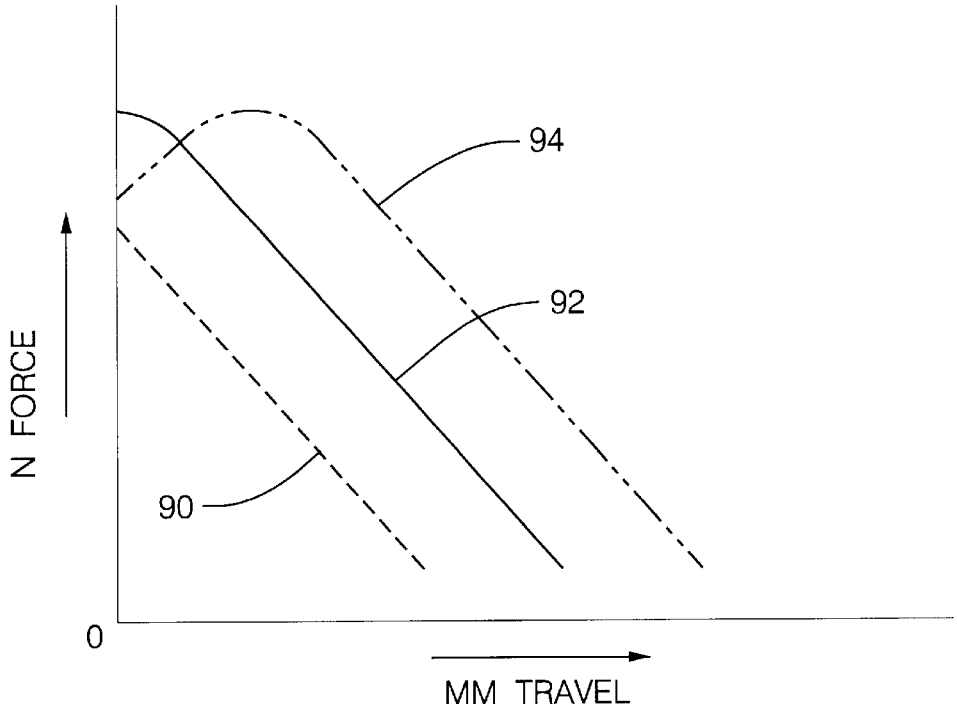
FIG. 3 is a graph comparing armature magnetic force versus valve travel for the initial armature positions shown in FIG. 2.

Referring now to FIG. 2, numerals 90, 92 and 94 illustrate various initial positions for the primary lower surface 23 of the armature 16 in the valve closed position relative to the adjacent upper edge 95 of the pole piece 20 of the valve. FIG. 3 presents a graph which compares force exerted by the armature against travel of the armature under the conditions indicated in FIG. 2 and illustrated by corresponding curves 90, 92 and 94. It will be seen that in position 90, the armature extends within and therefore overlaps the pole piece 20 a small amount in the initial position of the armature. In this condition, the curve 90 of FIG. 3 shows a relatively constant relation of force versus travel of the valve with the amount of force decreasing as the amount of valve travel increases. However, the maximum force, which might be applied by the armature, is less than that which is available from the design of the solenoid components.

Position 92 as shown in FIG. 2 has the main lower surface 23 of the armature 16 aligned with the upper edge of the pole piece 20. The corresponding curve 92 of FIG. 3 illustrates that the initial motion of the armature occurs at the point of the maximum magnetic force, dropping off rapidly in a relatively constant curve of force versus travel similar to that of curve 90. For an ordinary single pintle EGR valve, this would be the most desirable position for setting of the armature since the maximum magnetic force would be applied at the point of opening of the valve, where maximum force is required to overcome the differential pressure between the exhaust and intake systems acting across the valve head.

However, an alternative positioning of the armature 16 relative to the pole 20 in an underlapped condition is illustrated in FIG. 2 by numeral 94. In this condition, the primary lower surface 23 of the armature is positioned axially outward from the upper edge of the pole piece 20 so that initial motion of the armature occurs with less than the maximum available force.

Referring to FIG. 3, and line 94 therein, the force versus travel of the underlapped arrangement of FIG. 2 is illustrated. As may be seen, the armature force at initial valve opening is lower but increases to the maximum amount at the peak of the curve, after which it moves downwardly in a relatively constant ratio of force versus travel. It is this latter arrangement which is suggested as preferable for a concentric dual pintle valve of the type shown in FIG. 1. With this arrangement, the primary lower surface 23 of the armature 16 would be aligned with the upper edge of the primary pole piece 20 at the point where the lower surface 23 engages the upper end of stem 62 of the larger first pintle valve or the retainer cap 66 mounted thereon. Thus, initial opening of the smaller valve will be accomplished with a reduced armature force. This is acceptable because of the lower forces acting on the smaller valve which allow armature actuation with less than the maximum available armature force. Then, when the smaller valve is fully opened, the armature engages the larger first pintle valve at the point where the armature force is at a maximum and thus opens the larger valve at the armature's maximum force point. As the armature continues downward, the magnetic force developed is reduced, however it is sufficient to fully open the valve against the biasing spring and allow control of the valve opening to proceed along the curve 94 with a predetermined calibration of valve position versus force developed.

Use of the curve 94 and the underlapped position of the armature as suggested, requires a dual calibration of the curve for control of armature position and valve opening by the control program providing electric energy to the coil 14. The first calibration is of the left-hand portion of the curve from the initial opening of the smaller valve to the maximum magnetic energy point at the top of the curve. The second calibration extends from the top of the curve downward to the right along the relatively constant portion of line 94 as shown if FIG. 3. With these dual calibrations, the position of the armature can be located by a corresponding control program responding to the sensor drive arm 28 so that proper operation of the EGR valve can be maintained under all circumstances.

Figure 5:
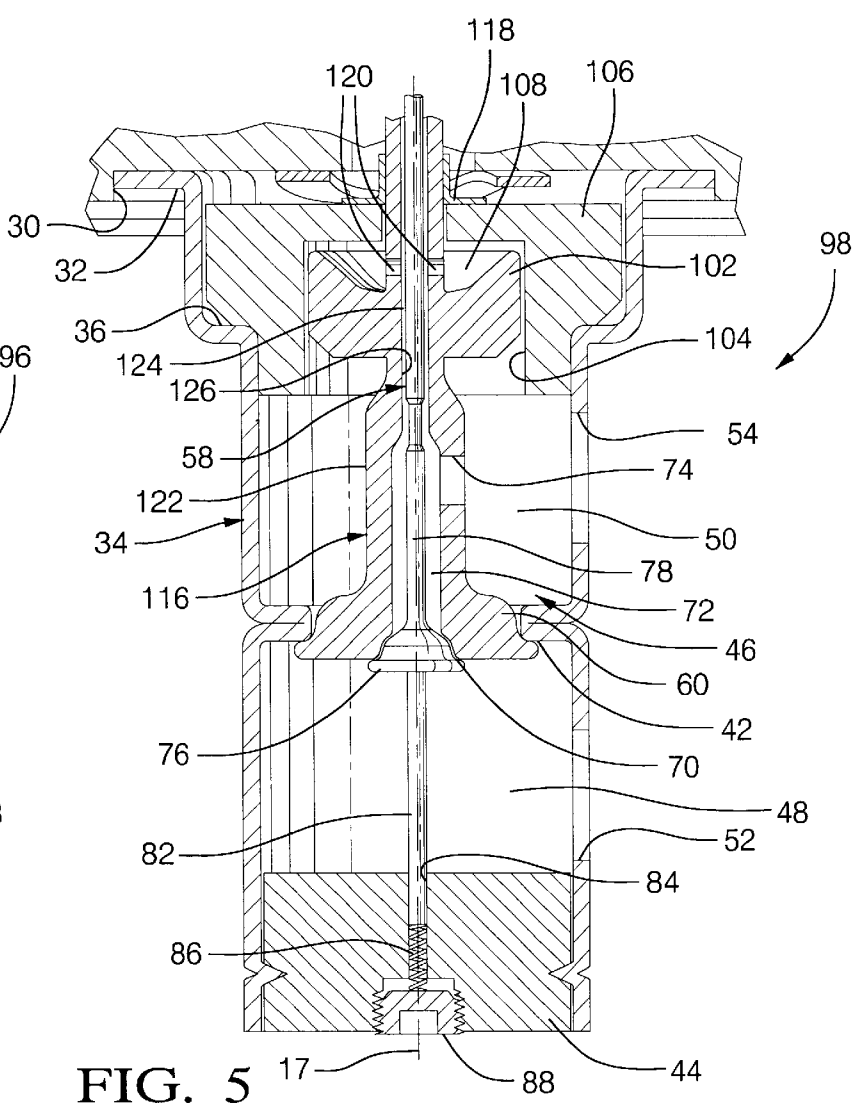
FIG. 5 is a view similar to FIG. 4 but showing a further modified valve providing full pressure balancing.
Figure 4:
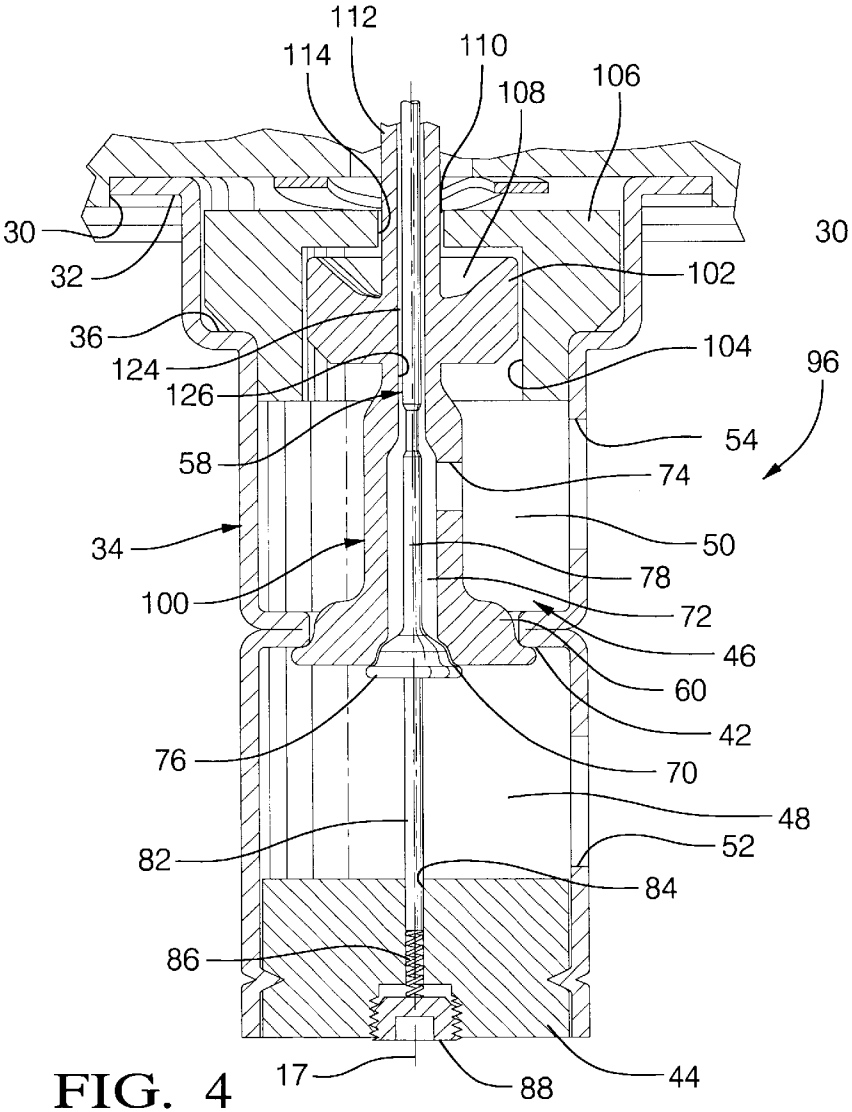
FIG. 4 is a fragmentary cross-sectional view similar to FIG. 1 but illustrating a modified valve providing partial pressure balancing.

Referring now to FIGS. 4 and 5, there are shown alternative embodiments of the valve body portions of EGR valves generally indicated by numerals 96 and 98 respectively. Both valves utilize some of the components from valve 10 of FIG. 1 so that like numerals indicate like parts. In FIG. 4,valve 96 differs in modification of the first pintle valve 100 to include a balance piston 102 received within a cylinder 104 in a modified floating bushing 106. The piston 102 has a close clearance in the cylinder 104 and defines a balance chamber 108 which communicates with ambient pressure through clearance 110 between the shaft 112 of valve 100 and a through opening 114 of the bushing 106.

In operation, ambient pressure in chamber 108 approximates exhaust pressure in the lower portion 48 of the valve chamber 46 and thus reduces the pressure differential acting on the first pintle valve 100 so that opening of this valve can be accomplished with less magnetic force than without the balancing piston arrangement.

In FIG. 5, valve 98 includes a first pintle valve 116 with a balance piston 102 in cylinder 104 of floating bushing 106 like the corresponding components of the embodiment of FIG. 4. However, the balance chamber 108 is sealed against exposure to ambient pressure by a shaft seal 118. Instead, when the second pintle valve 58 is open, the balance chamber 108 communicates with the valve chamber lower inlet portion 48 to balance pressures on the first pintle valve 116 and allow it to be opened with a smaller magnetic force than would be needed for an unbalanced valve. The communication of balance chambers 108 is through balance ports 120 in the first pintle shaft 122, then through increased clearance 124 between the upper portion of the second pintle shaft 78 and a through opening 126 in the first pintle shaft 122 through which the stem 78 extends, and finally through the low flow passage 72 which in turn connects with exhaust pressure in the inlet portion 48 of the valve chamber when the second pintle valve 58 is open.

The specific construction of various components of the illustrated embodiments of the invention is intended to be exemplary and not limiting as to the invention. Thus, the drawn seat tube or valve body could be replaced by a casting or other suitable structure. Similarly the pintles, bushing, end cap and components of the solenoid actuator may be replaced with suitable alternative constructions. Also, other forms of actuators, such as stepping motors or pressure devices, could be used instead of a solenoid armature and such known alternative devices should be considered within the scope of the claims.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An EGR valve for controlling exhaust gas recirculation flow in an engine, said valve comprising;

a housing enclosing an actuator reciprocable in the housing on an axis;

a valve body connected with the housing and defining a valve chamber including axially spaced inlet and outlet openings and a first valve seat between the openings;

first and second pintle valves mounted in the valve body and reciprocable on said axis;

said first valve engagable with the first valve seat in the first valve closed position, the first valve including a second valve seat connecting through an internal low flow passage with a connecting opening to the valve chamber;

said second valve extending concentrically within the first valve and engagable with the second valve seat in a second valve closed position; and first and second biasing means respectively biasing the first and second valves toward their valve closed positions;

said actuator being controllably movable over a total stroke including consecutive first and second stages, the actuator being operative to controllably open the second valve in the first stage of the stroke to allow EGR flow between the valve body inlet and outlet openings only through the low flow passage in the first valve and to controllably open the first valve in the second stage of the stroke to allow flow between the valve body inlet and outlet openings through the valve chamber of the valve body.

2. An EGR valve as in claim 1 wherein the first valve includes a first pintle shaft and the second valve includes a second pintle shaft extending through the first shaft, the actuator engaging the second pintle shaft and being axially spaced from the first pintle shaft when both valves are in their closed positions.

3. An EGR valve as in claim 1 wherein said actuator is a solenoid actuated armature.

4. An EGR valve as in claim 3 wherein said housing includes a magnetic pole having a recess toward which the armature is drawn by solenoid actuation of the armature, the solenoid actuation developing a force that is maximized when the armature and recess are aligned with a primary lower surface of the armature adjoining an upper edge of the pole recess.

5. An EGR valve as in claim 4 wherein the armature and recess are so aligned at a point when the armature initially contacts the first pintle shaft to begin opening of the first valve.

6. An EGR valve as in claim 1 and including a pressure balance piston on the first valve and movable within a balance cylinder opening to a portion of the valve chamber.

7. An EGR valve as in claim 6 wherein the balance cylinder is communicated with ambient pressure to partially balance inlet gas forces on the first valve.

8. An EGR valve as in claim 6 wherein the balance cylinder is communicated with gas pressure in the low flow passage to fully balance gas forces on the first valve when the second valve is open.

9. An EGR valve as in claim 1 wherein said first valve includes a first pintle shaft through which the internal low flow passage extends from the second valve seat to said outlet opening.

10. An EGR valve as in claim 9 wherein said second valve includes a second pintle shaft that extends through the internal low flow passage and beyond said opening to close clearance with a reduced diameter portion of the hollow interior of the first pintle shaft.

* * * * *